United States Patent [19]

Dang et al.

[11] Patent Number: 4,578,885

[45] Date of Patent: Apr. 1, 1986

[54] TENTERING FRAME FOR SHEET-LIKE MEMBERS

[75] Inventors: Hiep D. Dang; Roy L. Hicks; Joel F. M. Leathers, all of Lake Jackson, Tex.

[73] Assignee: The Dow Chemical Company, Midland, Mich.

[21] Appl. No.: 759,770

[22] Filed: Jul. 29, 1985

[51] Int. Cl.[4] ..... D06C 3/08

[52] U.S. Cl. ..... 38/102.91; 38/102.1; 38/102.6; 204/255; 160/380

[58] Field of Search ..... 38/102.4, 102.1, 102.2, 38/102.91, 102.6; 160/380, 382, 383, 400, 403, 402, 378; 204/255, 268, 252, 248, 285

[56] References Cited

U.S. PATENT DOCUMENTS

| | | | |
|---|---|---|---|
| 362,230 | 5/1887 | Schaubel | 38/102.4 |
| 895,744 | 8/1908 | Goldberger | 38/102.6 |
| 1,636,681 | 7/1927 | Carbone | 38/102.91 |

FOREIGN PATENT DOCUMENTS

| | | | |
|---|---|---|---|
| 16133 | of 1907 | United Kingdom | 38/102.4 |

*Primary Examiner*—Werner H. Schroeder
*Assistant Examiner*—Andrew M. Falik
*Attorney, Agent, or Firm*—Joe R. Prieto

[57] ABSTRACT

A tentering apparatus for tensioning a sheet-like member, for example, a membrane used in an electrolyzer. The tentering apparatus includes four clamping assemblies arranged in a picture frame shape configuration adapted for clamping at least a portion of its periphery of a sheet-like member. One pair of clamping assemblies have studs at each end rotatably mounted at the ends of the second pair of clamping assemblies. A planar sheet-like member is tensioned by clamping the periphery of the sheet-like member and applying a pulling force generally outwardly and normal to the second pair of clamping assemblies and rotating the first pair of clamping assemblies to cause a pulling force generally normal to the first pair of clamping assemblies.

4 Claims, 9 Drawing Figures

TENTERING FRAME FOR SHEET-LIKE MEMBERS

BACKGROUND OF THE INVENTION

This invention relates to an apparatus for tentering sheet-like members and more particularly this invention relates to a tentering frame for tentering membranes used in electrolyzers.

Electrolyzers employing a membrane (hereinafter "membrane cells") may be of the filter press type, for example, as described in U.S. Pat. Nos. 4,108,742 and 4,111,779. Membrane materials commonly used for membrane cells include, for example, those marketed by E. I. duPont de Nemours & Company under the trademark Nafion® and by Asahi Glass Company Ltd. under the trademark Flemion®. The membranes are available principally in sheet-like form. The membrane is used for separating the cell into electrode compartments containing electrolyte. For example, a membrane cell used for the production of a halogen and an alkali metal hydroxide may use an ion exchange membrane to separate an anode compartment containing anolyte and an anode member from a cathode compartment containing catholyte and a cathode member.

In a membrane cell used, for example, in the production of a halogen and an alkali metal hydroxide, it is important to keep the distance between electrodes to a minimum to reduce the voltage drop through the catholyte and anolyte, and thus reduce energy consumption of the cell. Furthermore, it is advantageous to keep a uniform spacing between an electrode and the membrane to obtain a uniform current distribution. Any contact between the membrane and an electrode may cause a great amount of current passage and membrane burning at the point of contact. In some applications, the spacing between an electrode and membrane may be no greater than 1 millimeter. Therefore, the membrane is kept as flat or planar as possible when installed between electrodes of an electrolytic cell.

Some membrane materials are known to absorb water and expand a certain percentage when wetted. Thus, it is common for these types of membranes to form wrinkles during operation of a cell when the membrane is wetted with electrolyte. A wrinkled membrane can come into contact with the cell electrodes and cause the problems described above. A wrinkled membrane can also reduce the circulation of the electrolyte and trap gases produced in the cell between the electrode and the membrane face. This may result in a nonuniform increase in resistivity of the electrolyte solution in the interelectrode space with a nonuniform current distribution across the membrane surface in the vertical direction. It is important, therefore, to keep the membrane as flat as possible and prevent wrinkles from forming on the membrane surface when installing in the cell.

Heretofore, the installation of membranes between electrode compartments required a crew of about six to eight people holding the membrane in place and pulling the membrane by hand to tension the membrane between electrode units until the electrode compartment units were squeezed together by, for example, a hydraulic ram. Invariably, this procedure led to formation of wrinkles on the membrane due to uneven forces pulling at the membrane by the crew. The wrinkles formed at a gasket bearing surface of the membrane caused leakage of electrolyte into the atmosphere or electrode compartments. Furthermore, installation of the membrane consumed a relatively long period of time and dropping the membrane, which meant starting the installation process over, was always a risk.

It is desired to minimize the problems discussed above by providing an apparatus and method for tentering a membrane used in a membrane cell and maintaining the membrane planar when installed in a membrane cell.

SUMMARY OF THE INVENTION

The present invention is directed to an apparatus and method for tentering a generally planar sheet-like member. The apparatus comprises at least a first pair of clamping assemblies generally parallel and spaced apart positioned between a second pair of clamping assemblies generally parallel and spaced apart to form a picture frame type configuration. The clamping assemblies are adapted for clamping at least a portion of the periphery of a sheet-like member, said clamping assemblies comprising a pair of independent and separate elongated generally planar members wherein the elongated portion of the member is adjacent and parallel each other and fixed together with a fastening means. The first pair of clamping assemblies have studs at each end rotatably mounted at the ends of the second pair of clamping assemblies.

The generally planar sheet is tensioned by clamping the periphery of the sheet-like member and applying a pulling force generally outwardly and normal to the second pair of clamping assemblies and rotating the first pair of clamping assemblies to cause a pulling force generally normal to the first pair of clamping assemblies.

DETAILED DESCRIPTION OF PREFERRED EMBODIMENTS

Figure 1:
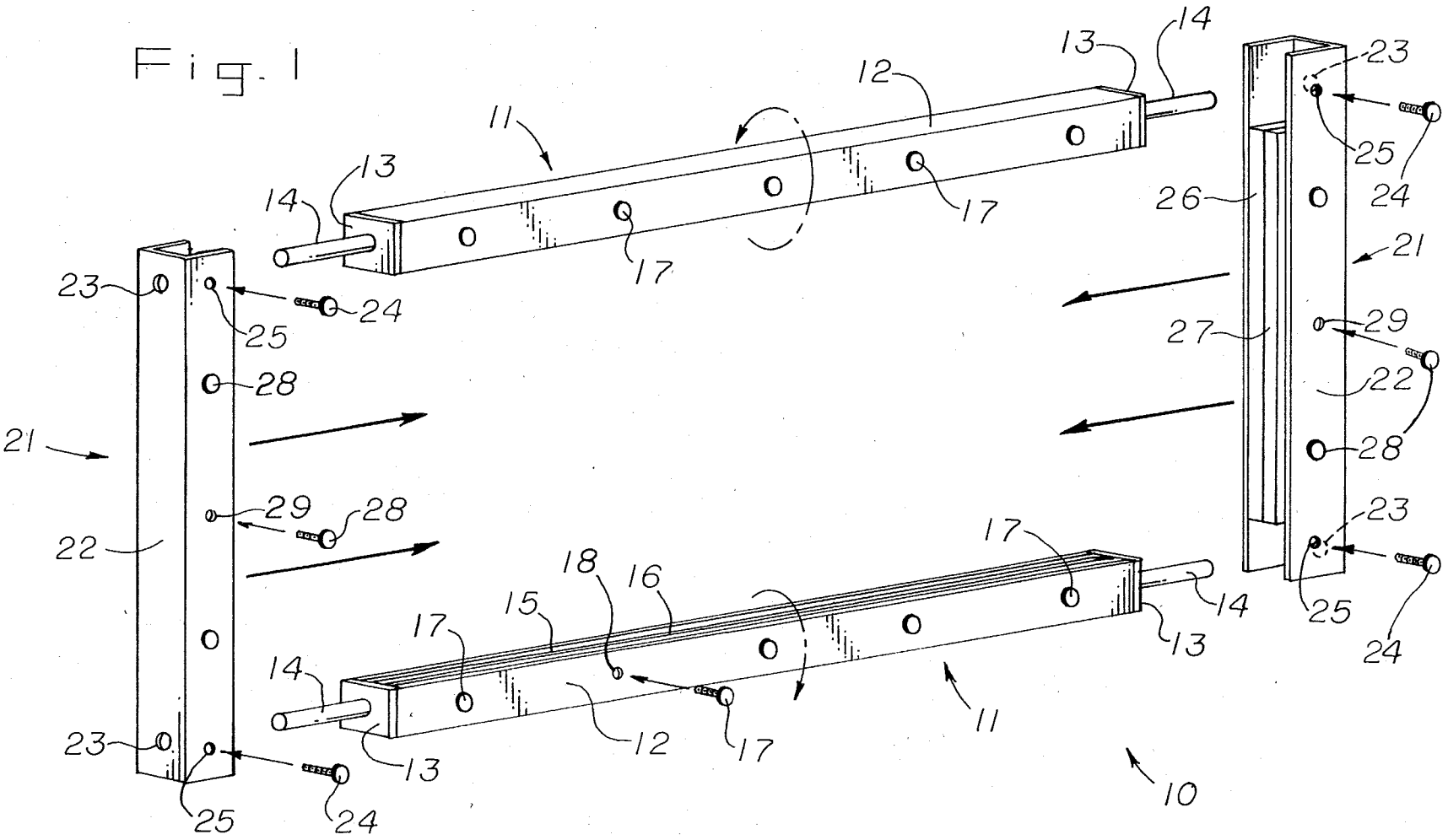
FIG. 1 is a partially exploded perspective view of one embodiment of the tentering frame, according to the present invention, showing two pairs of clamping assemblies.
Figure 2:
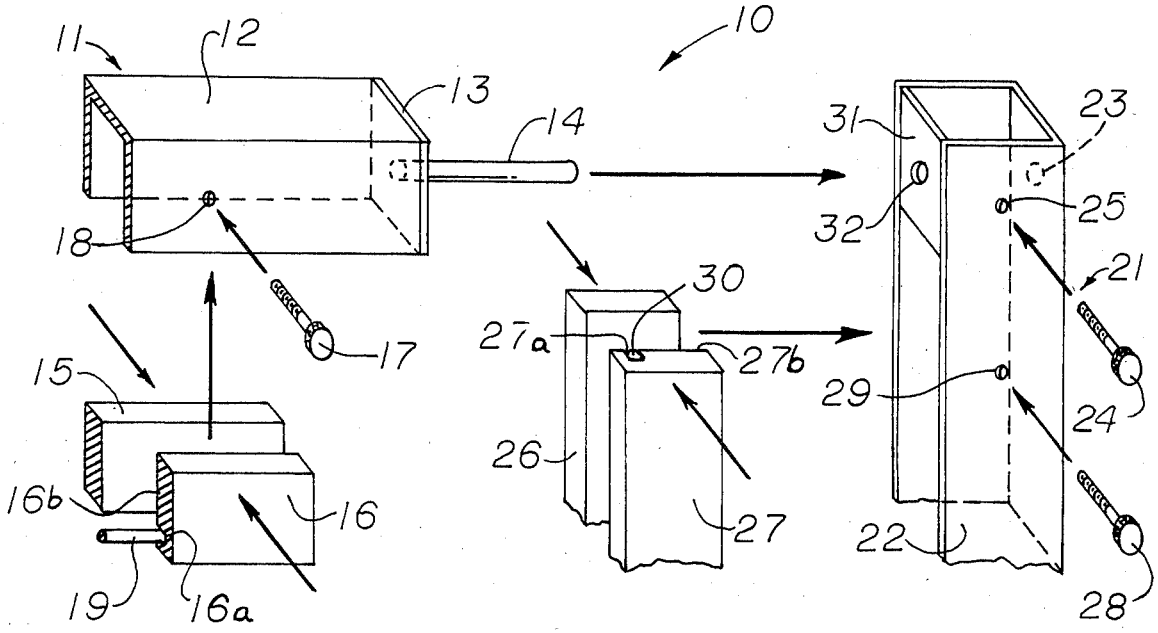
FIGS. 2, 3, 4, and 5 are other embodiments of the tentering frame of the present invention, showing an exploded perspective view of a corner portion of the tentering frame.
Figure 4:
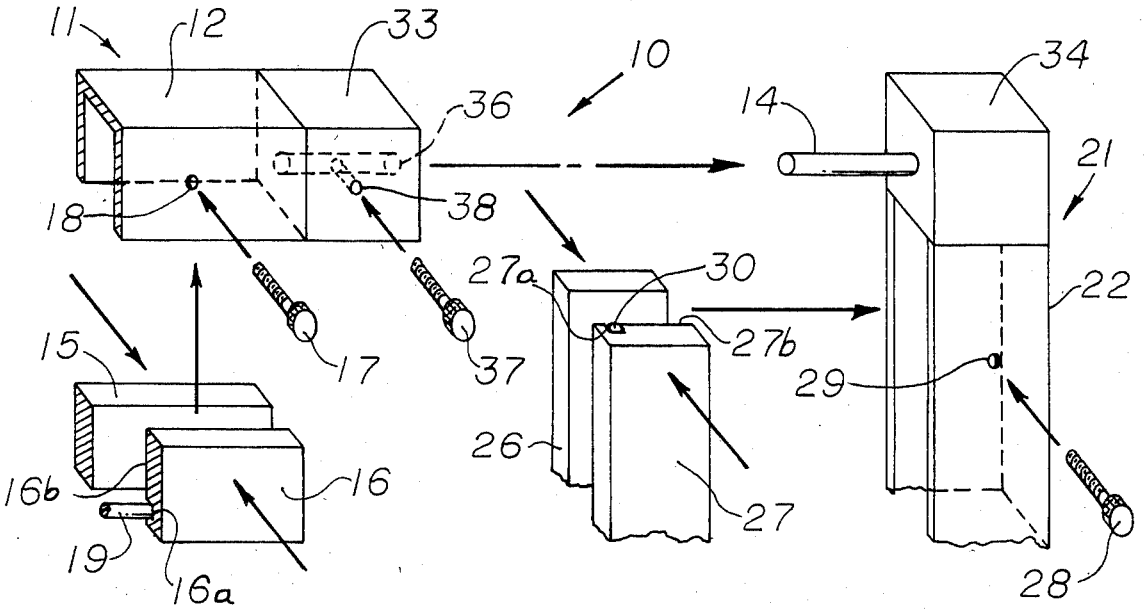
Figure 5:
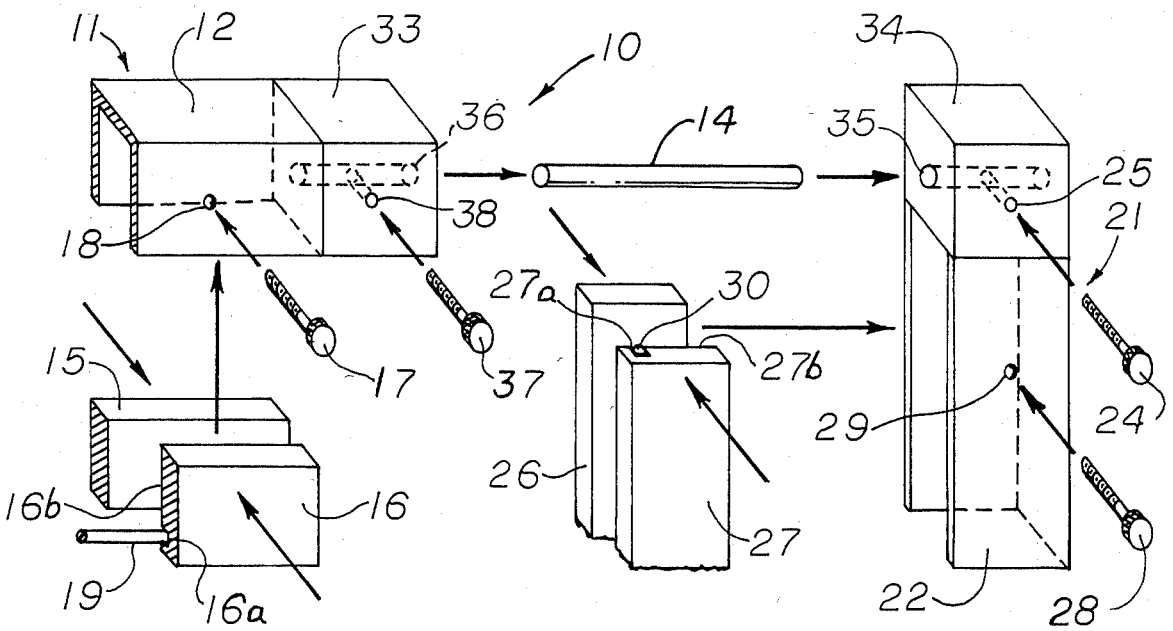
Figure 6:
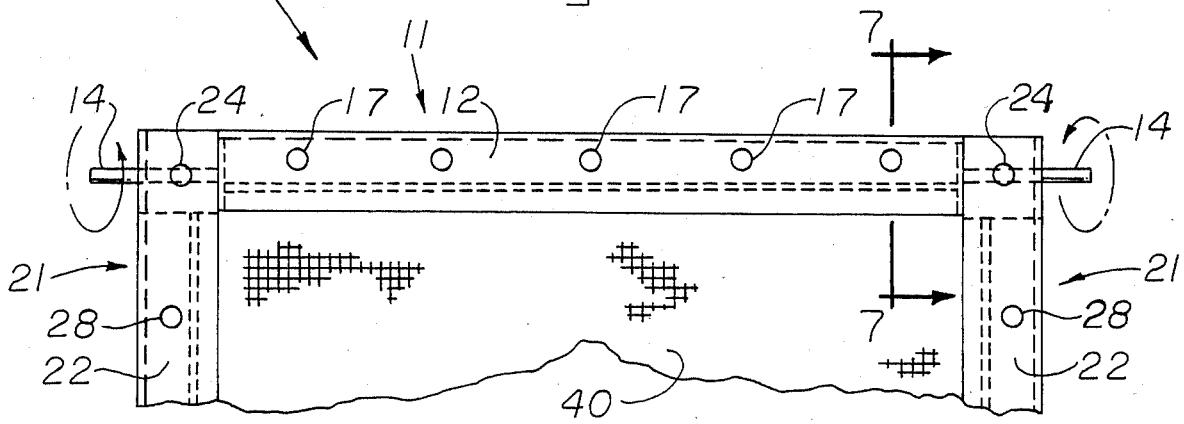
FIG. 6 is a front view of a portion of an assembled apparatus of FIG. 1 with a sheet-like member.

With reference to FIGS. 1–6, there is shown various preferred embodiments of the apparatus of the present invention which is designated generally as numeral 10 (hereinafter tentering frame 10). As shown in FIG. 1, in a partially exploded view, the tentering frame 10 may consist essentially of a first and a second pair of clamping assemblies indicated by numerals 11 and 21, respectively, which may be connected and fastened together in a rectangular picture frame type configuration. The tentering frame 10 is used for tensioning a sheet-like member 40, as shown in FIG. 6. The tentering frame 10 in this instance is rectangular in shape, but broadly speaking, the tentering frame 10 may be of any other shape as that of the sheet-like member, for example, square or hexagonal.

Generally, the tentering frame 10 comprises a first pair of longitudinal clamping assemblies 11 which are generally parallel and spaced apart, and assemblies 11 are positioned between a second pair of transversal clamping assemblies 21 which are generally parallel and spaced apart. The first pair of clamping assemblies 11 comprise a longitudinal "U-shaped" clamp channel 12 with flat plates 13 at each end. "U-shaped" refers to the view of the channel member 12 in cross-section. A stud 14 is attached to each end plate 13 for rotatably mounting the longitudinal clamping assemblies 11 to the transversal clamping assemblies 21. Any means of attaching the stud 14 to the end plates 13 may be used, such as welding or threading. The U-shaped clamp channel 12 has a releasable means for tightening a first and second clamping bar, 15 and 16, respectively, which are parallel and adjacent each other and juxtaposed between the arms of the "U" or flanges of the U-shaped clamp channel 12. The releasable means for tightening the clamping bars 15 and 16, may be in the form of a plurality of clamping screws 17 and threaded openings 18 adapted to receive the clamping screws 17. The clamping screws 17 and the threaded openings 18 are preferably located on at least one flange of the U-shaped clamp channel 12.

Figure 8:
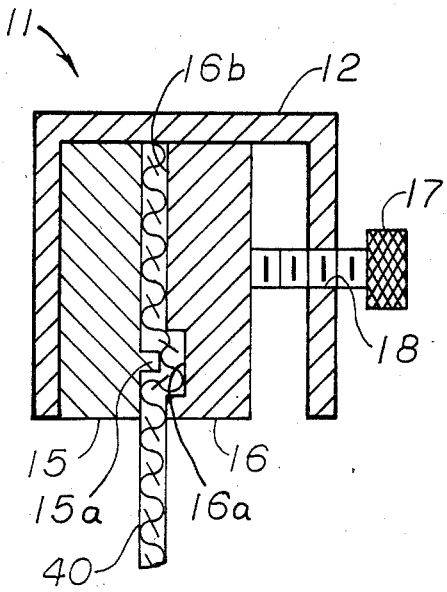
FIG. 8 is a cross-section view, similar to FIG. 7, of another embodiment of the present invention, showing a clamping assembly with a sheet-like member.
Figure 7:
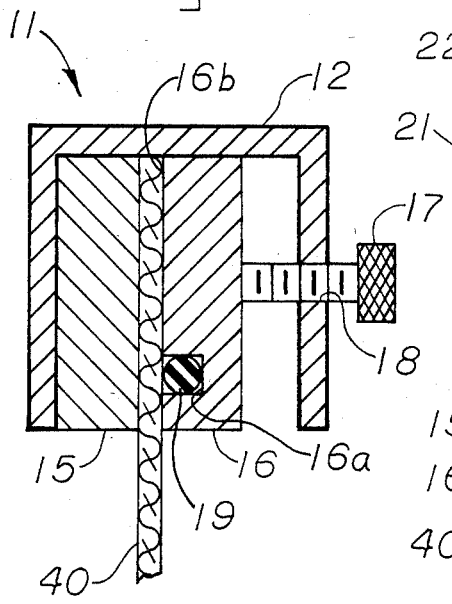
FIG. 7 is a cross-section view taken along line 7—7 of FIG. 6, showing a clamping assembly with a sheet-like member.
Figure 9:
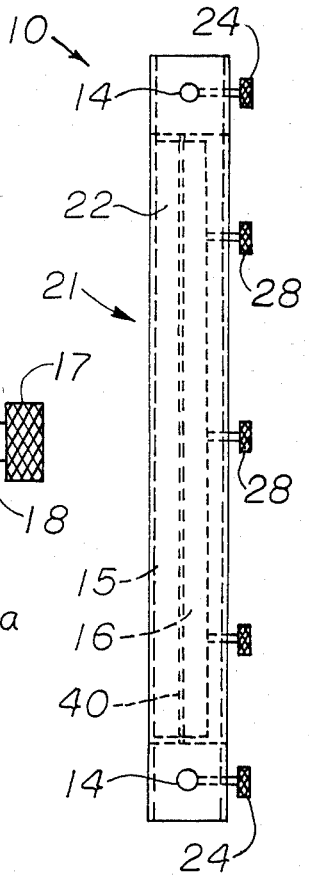
FIG. 9 is a side view of the assembled apparatus of FIG. 6.

A gripping means, best illustrated in FIGS. 7 and 8, is provided on at least one of the clamping bars 15 or 16 to tightly secure or to grip the sheet-like member 40 around its periphery as the sheet-like member is fastened between clamping bars 15 and 16. The gripping means in this instance is a longitudinal recess 16*a* adapted to receive a securing member 19. The recess 16*a* is provided on the inner planar surface 16*b* of clamping bar 16. The securing member 19 may be in the form of a solid piece, a strip or a tubing. Preferably, the securing member 19 may be made of resilient materials such as rubber, ethylene-propylene-diene monomer (EDPM), chlorinated polyethylene (CPE) and neoprene. The recess 16*a* and securing member 19 provides a tightly secured or gripped sheet-like member 40 during tentering, stretching or tensioning the sheet-like member 40.

In another embodiment, as illustrated in FIG. 8, the sheet-like member 40 is gripped by means of a longitudinal rib 15*a* on at least one of the clamping bars, i.e., clamping bar 15 and a longitudinal groove 16*a* adapted for receiving the rib 15*a* on the other clamping bar 16. Other gripping means (not shown) useful in the present invention may include a knurled surface or roughened uneven surface located on at least a portion of the surface of at least one clamping bar contacting the periphery of the sheet-like member 40.

Again, with reference to FIGS. 1–6 the first pair of assemblies 11 are rotatably mounted to the end portions of the second pair of clamping assemblies 21. The second pair of clamping assemblies 21 comprise a transversal U-shaped clamp channel 22 with at least one opening 23 adapted to receive the stud 14 of clamping assemblies 11. The opening 23 is located at the end portion of U-shaped clamp channel 22. The clamping assemblies 11 are rotatably supported by the clamping assemblies 21. The stud 14 is extended through the opening 23, as shown in FIG. 6, to provide rotation of clamping assemblies 11 on its axis relative to the clamping assemblies 21 and axial movement along the stud 14 by clamping assemblies 21.

At each end portion of the clamp channel 22, there is at least one releasable means for tightening against the stud 14, holding the stud 14 in a nonrotatable position, and holding the clamping assemblies 21 in a nonslidable position along the axis of stud 14. The releasable means, in this instance, is preferably set screws 24 and threaded openings 25 adapted to receive the set screws 24. The set screws 24 and threaded openings 25 are preferably located on at least one arm of the "U" or flange of the U-shaped clamp channel 22 at the end portion of U-shaped clamp channel 22. The set screws 24, when tightened, prevents rotation of the clamping assemblies 11 and axial movement of clamping assemblies 21 along the axis of the stud 14.

The transversal U-shaped clamp channel 22 has a releasable means for tightening a first and second clamping bar, 26 and 27, respectively, which are parallel and adjacent each other and juxtaposed between the flanges of the U-shaped channel 22. The releasable means for tightening the clamping bars 26 and 27, may be in the form of a plurality of clamping screws 28 and threaded openings 29 adapted to receive clamping screws 28. The clamping screws 28 and threaded openings 29 are preferably located on at least one flange of the U-shaped clamp channel 22.

The gripping means used for clamping bars 26 and 27 may be the same aforementioned gripping means used for clamping bars 15 and 16. For example, at least one of the clamping bars, in this instance clamping bar 27, has a longitudinal recess 27*a* adapted to receive a securing member 30 on the inner planar surface 27*b* of clamping bar 27. The securing member 30 may be of the same form and material as the securing member 19, for example, a solid piece, a strip or tubing of EPDM material. In another embodiment, a longitudinal rib and recess similar to the rib and recess shown for clamping bars 15 and 16, respectively, in FIG. 8, may be used as the gripping means for clamping bars 26 and 27, respectively. Other means for gripping the sheet-like member that may be used in the present apparatus, are, for example, surface knurling and surface roughening as described above.

Other embodiments for the tentering frame 10 of the present invention are shown in FIGS. 2, 3, 4, and 5. With respect to FIG. 2, a corner portion of the tentering frame 10 is shown, wherein the stud or rod 14 is fixed to the flat plate 13 of the U-shaped clamp channel 12. The U-shaped clamp channel 22 of clamping assemblies 21 contains an opening 23 adapted to receive stud 14. In addition, the end portion of the U-shaped clamp channel 22 contains a support plate 31 with an opening 32, also adapted to receive the stud 14 of clamping assemblies 11.

Figure 3:
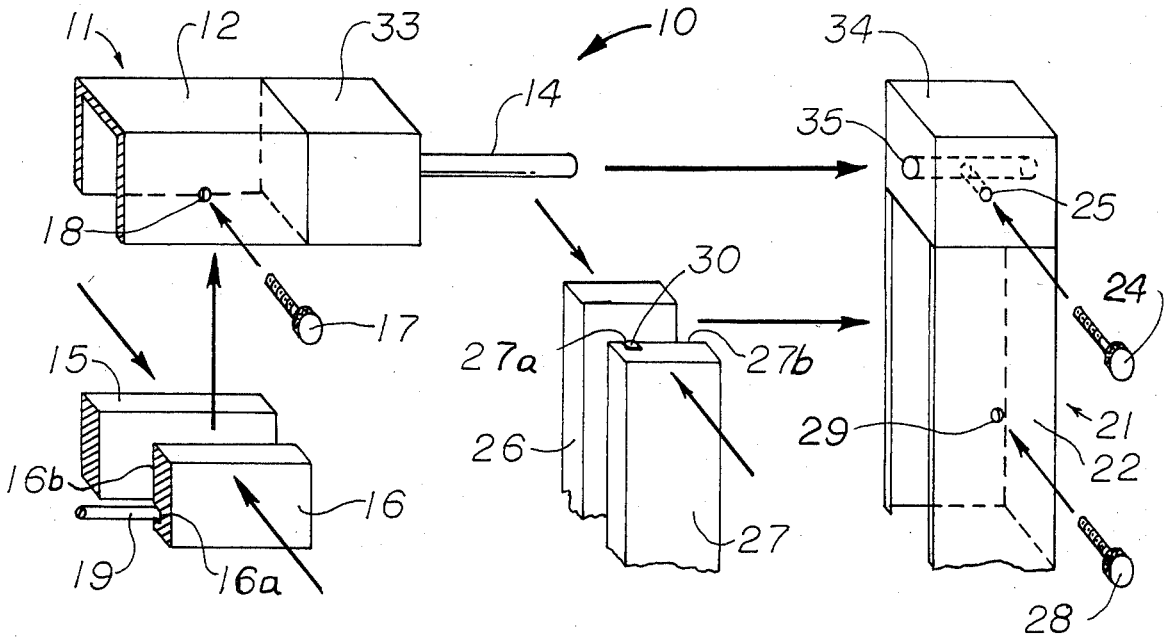

FIG. 3 is another embodiment of the present invention, showing a corner portion of the tentering frame 10. FIG. 3 shows the end portions of the clamping assemblies 11 and 21 having a solid block 33 and 34, respectively, attached to U-shaped clamp channel 12 and 22, respectively, with the block 34 having a bore 35 therethrough adapted to receive the stud 14 which is attached to block 34. The stud 14 may be fixed to the block 33 by any means such as welding or threading. The block 34 contains at least one releasable means in the form of a set screw 24 and a threaded opening 25 adapted for receiving the set screw 24 for tightening against the stud 14, holding the stud 14 in a nonrotatable position, and holding the clamping assemblies 21 in a nonslidable position along the axis of the stud 14.

FIG. 4 is yet another embodiment of the present invention, showing a corner portion of the tentering frame 10, wherein the end portions of the assemblies 11 and 21, respectively, contain the solid block 33 and 34, respectively, with the block 33 having a bore 36 adapted to receive the stud 14 which is fixed to the block 34 of the assemblies 21. The stud 14 may be fixed to the block 34 by any means such as welding or threading. The block 33 has at least one releasable means for tightening the stud 14, holding the stud 14 in a nonslidable position, and holding the clamping assemblies 11 in a nonrotatable position along the axis of stud 14. The releasable means may be in the form of a set screw 37 and a threaded opening 38 adapted to receive the set screw 37.

FIG. 5 is still another embodiment of the present invention, showing a corner portion of the tentering frame 10, wherein there is shown a free-floating stud 14 adapted to project through the bores 35 and 36 of the blocks 34 and 33 respectively, of the assemblies 21 and 11, respectively. The set screws 24 and 37 and the threaded openings 25 and 38, respectively, are used for tightening against the stud 14, holding the stud 14 in a nonrotatable position and holding the stud 14 in a nonslidable position.

With reference to FIGS. 6–9, in a preferred method of carrying out the stretching or tensioning of a sheet-like member using the tentering frame 10 of the present invention, the edges of two opposite and generally parallel ends of a sheet-like member 40 are sandwiched between clamping bars 15 and 16 of clamping assemblies 11. The clamping screws 17 are loosely tightened to allow the member 40 to slide between the clamping bars 15 and 16. The clamping assemblies 21 are attached to clamping assemblies 11 by extending the studs 14 of clamping assemblies 11 through openings 23 at each end portion of clamping assemblies 21. The two remaining edges of the ends of a sheet-like member are sandwiched between clamping bars 26 and 27 of clamping assemblies 21 and the member is secured by tightening the clamping screws 28. By sliding the clamping assemblies 21 outwardly along the axis of studs 14, the sheet-like member may be pulled and stretched in the lateral direction perpendicular to the clamping assemblies 21. The set screws 24 may be tightened, temporarily to hold the stretch or tautness of the sheet-like member 40. Then the edges between the clamping bars 15 and 16 are secured by tightening the clamping screws 17 of the clamping assemblies 11. The set screws 24 of at least one clamping assembly 11 of the pair of clamping assemblies 11 is loosened to rotate the clamping assembly 11 on the axis of stud 14. By rotating the clamping assembly 11 on the axis of the stud 14, the sheet-like member may be stretched in the vertical direction perpendicular to the clamping assemblies 11. After rotating the clamping assembly 11 on the axis of the stud 14, the set screws 24 are tightened to secure the stretch or tautness in the vertical direction. The clamping screws 28 of at least one of the clamping assemblies 21 may be loosened and retightened as needed to allow for a uniform stretching as assembly 11 is rotated. Any wrinkles formed on the sheet-like member surface are removed. When a uniform stretch and desired tautness is achieved, the set screws 17 and 28 are checked for tightness to maintain tension on the sheet-like member until the member is ready for use. It is to be understood that the above method for tensioning the sheet-like member is a preferred method only and the present invention is not to be limited thereto.

In its broadest application, the apparatus of the present invention may be used where a generally planar sheet-like member is desired to be tensioned or stretched. For example, the apparatus of the present invention is particularly useful for tensioning membranes employed in electrolyzers, in particular, electrolyzers of the filter press type, which may be monopolar or bipolar. Such electrolyzers may be used, for example, for the production of chlorine and an alkali metal hydroxide by processes well known in the art. Examples of such electrolyzers are described in U.S. Pat. Nos. 4,108,742 and 4,111,779.

Membranes which may be tensioned by the apparatus of the present invention and which are used in electrolytic cells of the filter press type include, for example, membranes having ion exchange properties and which are substantially impervious to the hydrodynamic flow of electrolyte and the passage of gas products produced in the cell. Cation exchange membranes such as those composed of fluorocarbon polymers having a plurality of pendant sulfonic acid groups or carboxylic acid groups or mixtures of sulfonic acid groups and carboxylic acid groups are typically employed in electrolytic cells. The terms "sulfonic acid groups" and "carboxylic acid groups" are meant to include salt of sulfonic acid or salts of carboxylic acid which are suitably converted to or from the acid group by processes such as hydrolysis. One example of a suitable membrane of the sulfonic acid type cation exchange membranes are those sold commercially by E. I. duPont de Nemours and Company under the trademark Nafion®. Carboxylic acid type cation exchange membranes are commercially available from the Asahi Glass Company under the trademark Flemion®.

What is claimed is:

1. A tentering apparatus for tensioning a sheet-like member comprising:

at least a first pair of clamping assemblies generally parallel, spaced apart, and positioned between at least a second pair of clamping assemblies generally parallel and spaced apart to form a picture frame type configuration and adapted for clamping at least a portion of the periphery of the sheet-like member, the first and second clamping assemblies comprising a pair of independent and separate elongated, generally planar members, wherein the elongated portions of each member are adjacent and parallel to each other and held together with a fastening means; and the first pair of clamping assemblies having studs at each end, the second pair of clamping assemblies slidably mounted on the studs, and the first pair of clamping assemblies rotatably mounted to the second pair of clamping assemblies.

2. The apparatus of claim 1 wherein the fastening means is a clamp screw.

3. The apparatus of claim 1 wherein the fastening means is a plurality of clamp screws and a U-shaped clamp channel.

4. The apparatus of claim 1 wherein the sheet-like member is a membrane.

* * * * *